United States Patent [19]

Adamek et al.

[11] Patent Number: 4,511,002

[45] Date of Patent: Apr. 16, 1985

[54] MULTIPLE TUBING HANGER TIE BACK SYSTEM AND METHOD

[75] Inventors: Frank C. Adamek, Pasadena; James V. Bonds; Charles D. Bridges, both of Houston, all of Tex.

[73] Assignee: Gray Tool Company, Houston, Tex.

[21] Appl. No.: 544,143

[22] Filed: Oct. 21, 1983

[51] Int. Cl.[3] ..... E21B 33/04; E21B 29/00

[52] U.S. Cl. ..... 166/382; 166/55; 166/75 R

[58] Field of Search ..... 166/55, 75 R, 82, 115, 166/116, 243, 297, 363, 364, 368, 382, 361

[56] References Cited

U.S. PATENT DOCUMENTS

| | | | |
|---|---|---|---|
| 3,692,107 | 9/1972 | Slator et al. | 166/55 |
| 3,720,260 | 3/1973 | Duck et al. | 166/361 |
| 4,043,389 | 8/1977 | Cobb | 166/55 |
| 4,420,042 | 12/1983 | Tunstall | 166/297 |

*Primary Examiner*—Stephen J. Novosad
*Assistant Examiner*—Bruce M. Kisliuk
*Attorney, Agent, or Firm*—L. James Ristas

[57] ABSTRACT

A multiple tubing hanger tie back arrangement is disclosed in a preferred embodiment associated with a shear ram tubing head system (10). The arrangement includes a lower tubing hanger (44) sealingly secured within a lower tubing head (28) for supporting a tubing string (22). The lower hanger includes a control shoulder (60) at its upper end and a tapered interior surface (62). An upper tubing hanger (70) spaced above the lower hanger is also sealingly secured within an upper tubing head (24). A tie back subassembly (90) connects the upper and lower hangers, and preferably includes a tubing member (94) and a spacer member (92). The spacer member includes a stab nipple (96) in interference engagement with the lower hanger interior surface (62), and a load transfer surface (98) abuting the control shoulder (60). The tubing member (94) is located in the bore of the shear ram (26) so that severance of the tubing member (94) does not disturb the production tubing string (22) supported by the lower hanger (44). After severance, the tie back stub can be readily removed. A method of installation is also disclosed, including the steps of adjusting the distance between the upper hanger (70) and load transfer surface (98) to match the critical distance between the upper hanger bowl (38) and lower hanger control shoulder (60), so that the installed tie back assembly maintains pressure and mechanical continuity through the stack (30).

13 Claims, 6 Drawing Figures

MULTIPLE TUBING HANGER TIE BACK SYSTEM AND METHOD

BACKGROUND OF THE INVENTION

This invention relates to production equipment for oil and gas wells, and more particularly to a subassembly for suspending a production tubing string to accomodate safety-related equipment in the wellhead.

Exploitation of underground petroleum deposits located beneath the ocean is most often accomplished by drilling and completing oil and gas wells from a fixed platform, wherein operations are performed similarly to those conducted on land. The man made platform provides the structure on which a drilling rig is mounted to drill the well and subsequently is the terminus of the casing strings and the wellhead assemblies. During production all producing operations and equipment are located on such a structure. Operationally, many similarities between land and platform operations exist but because of space limitations that exist on a platform it is normal that a multiplicity of wells will be sited to improve the cost effectiveness of platform drilling and completion. The need to provide additional safety devices in platform completions has led to the installation of down hole safety valves, surface safety valves and other safety techniques that are well recognized.

Recently, in an effort to further increase the safety of drilling and producing offshore platform wells, an additional safety device has been postulated, a shear ram blowout preventer (BOP) installed below the tubing head to provide a means of shearing the tubing and sealing the tubing string in event of a blowout. It would be the intent of this procedure to install the shear ram BOP on each well on the platform, suitably manifolded to hydraulic control systems which automatically operate in the event of a fire or a blowout. Only the well in which such an event occurs would be affected and the flow of fluids would be sealed.

SUMMARY OF THE INVENTION

It is one object of the present invention to provide a multiple tubing hanger tie back arrangement for a petroleum wellhead.

It is another object of the present invention to support tubing at two locations within the wellhead such that the tubing may be severed therebetween without dropping the lower tubing string into the hole.

In one embodiment of the invention, a lower tubing hanger, carried within a lower tubing head, is located near the lower end of the wellhead and supports the entire weight of the tubing string. An upper tubing hanger, carried by the upper tubing head, is connected to the bottom of an Xmas tree and supports no tubing weight. A tie back subassembly carried by the upper tubing hanger stab seals downwardly into the lower tubing hanger to provide a flow path from the tubing string to the Xmas tree during normal production operations, and may optionally include a tubing section disposed in the path of transversely mounted shear rams.

In a more specific embodiment of the invention, a production tubing string is threaded to the lower, inside portion of the tubing lower hanger and is suspended downwardly therefrom. A second tubing hanger having an upper neck adapted to engage the Xmas tree is spaced above the first tubing hanger, and has a lower, internally threaded portion. A tie back subassembly is threaded to the upper tubing hanger and has a lower stab nipple that produces an interference fit, metal-to-metal seal on the upper, internal surface of the lower tubing hanger. The tie back subassembly preferably includes a tubing section connected to the upper tubing hanger and, at its lower end, to a tie back spacer member. The spacer member has adjustment means thereon for interacting with a control shoulder on the lower tubing hanger to assure that, when the upper and lower tubing hangers are sealingly engaged with their respective upper and lower tubing heads, the stab nipple seals against the inner surface of the lower tubing hanger. In the prefered embodiment of the invention, the multiple tubing hanger arrangement is part of a shear ram tubing head system including shear rams mounted transversely to the tubing section portion of the tie back assembly.

In a method embodiment of the invention, the lower tubing hanger is first connected to the upper end of the tubing string and run into the lower tubing head where it is secured in place with conventional hold down screws. The upper tubing hanger and tie back member are assembled into a single unit, either at the factory or on site. The distance from the upper control shoulder of the lower tubing hanger, to the control shoulder of the landing bowl on which the upper tubing hanger will rest, is measured with a space out tool. Adjustment means on the tie back member are configured so that the distance from the landing surface on the upper tubing hanger to the landing surface on the exterior of the tie back member is exactly that measured by the space out tool. The tie back assembly is then lowered into the wellhead until the upper hanger lands in its bowl and the exterior of the tie back member lands on the upper portion of the lower tubing hanger. Substantially simultaneously, the stab nipple of the interior portion of the tie back member forms a metal-to-metal seal with the tapered internal mating surface of the lower tubing hanger.

An important advantage of the present invention when incorporated into a shear ram system is that, after complete shut in of the well upon actuation of the shear rams, the sheared tubing stub and connected portions of the tie back assembly can be readily removed through the wellhead stack. No torquing is required, since the pressure sealing and load-bearing mating surfaces of the tie back member were initially engaged by axial stabbing. The severed tie back assembly is easily retrieved by an upward force applied to the stub.

BRIEF DESCRIPTION OF THE DRAWINGS

The preferred embodiments of the invention and the best mode for carrying them out, will be described in the remainder of this specification in conjunction with the accompanying Figures, in which.

DESCRIPTION OF THE PREFERRED EMBODIMENTS

Figure 1:
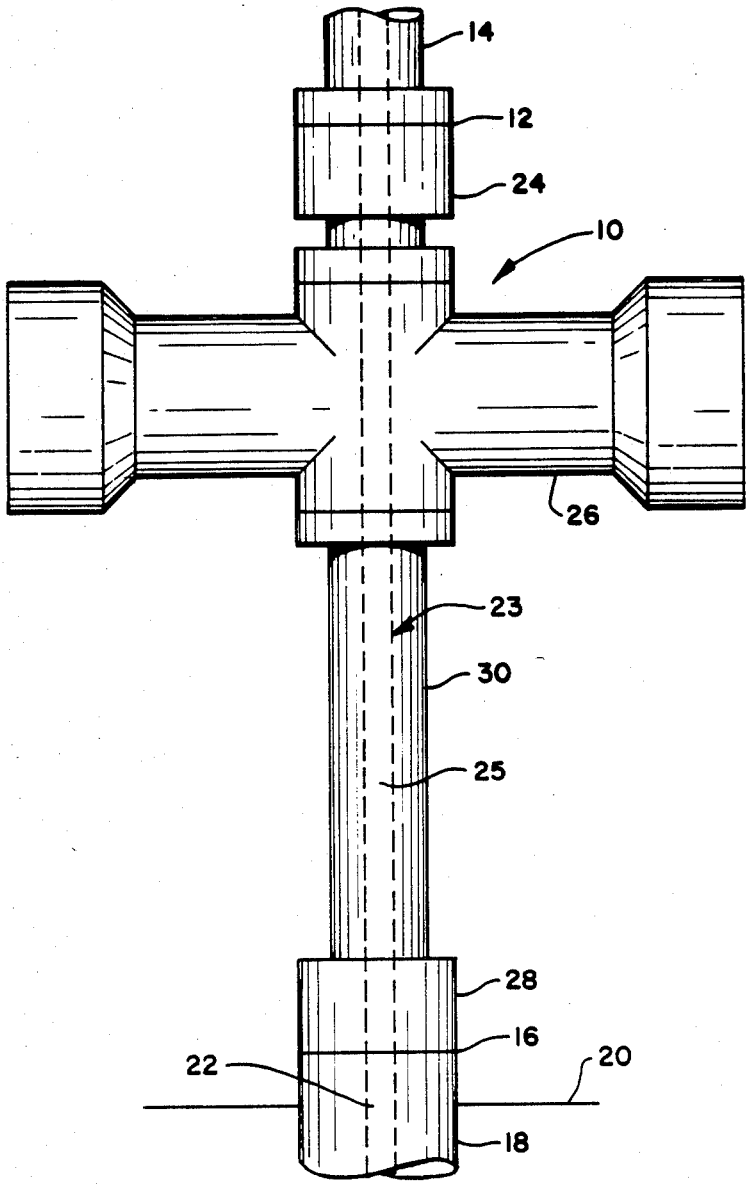
FIG. 1 is an elevation schematic view of a shear ram tubing head system including one embodiment of the invention.

The preferred embodiment of the invention will be disclosed as part of a shear ram tubing head system for improving resistance to blowouts in producing wells. As shown in FIG. 1, the shear ram tubing head system housing 10 is connected at its upper end through upper connector interface 12 to, typically, an Xmas tree 14, and at its lower connector interface 16 to a wellhead 18. A wellhead support structure, shown generally at 20, supports the wellhead components 18, 10, and 14 with respect to a frame of reference such as an offshore production platform (not shown). Production tubing 22 is shown in phantom descending from above the wellhead 18 into the well bore whereby petroleum is brought through the wellhead.

In the preferred embodiment of the invention, a production tubing tie back assembly 23 is provided in the generally cylindrical passageway 25 between the production tubing 22 and the Xmas tree 14, as part of the shear ram tubing head system 10. The invention includes a novel arrangement of an upper tubing head 24, a tubing shear ram 26, and a lower tubing head 28. For convenience, the structure surrounding the tie back assembly 23, between the lower connector interface 16 and the upper connector interface 12, will be referred to as the stack 30.

As will be more fully explained below, the shear ram tubing head system 10 is designed to sever the tubing in the tie back assembly 23 in the event of a blowout, while preventing any downward motion of the production tubing string 22. This is accomplished in the preferred embodiment by providing two independently supported tubing hangers connected by a tie back subassembly, such that the production tubing 22 continues to be secured within the lower tubing head 28, after severance of the tie back assembly 23.

Figure 2:
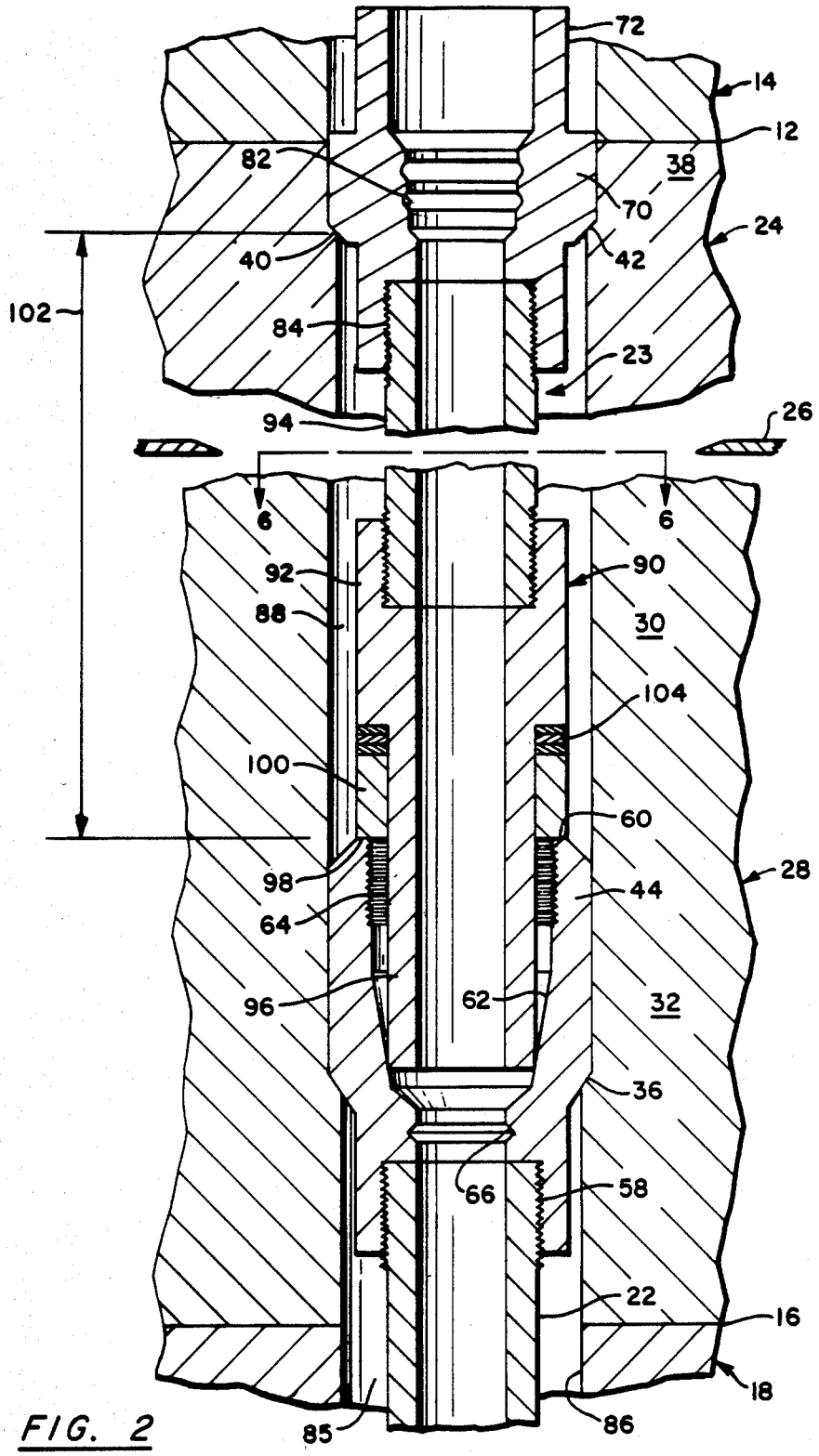
FIG. 2 is a schematic, sectioned view of the multiple tubing hanger and tie back assembly contained within the tubing head system of FIG. 1.
Figure 3:
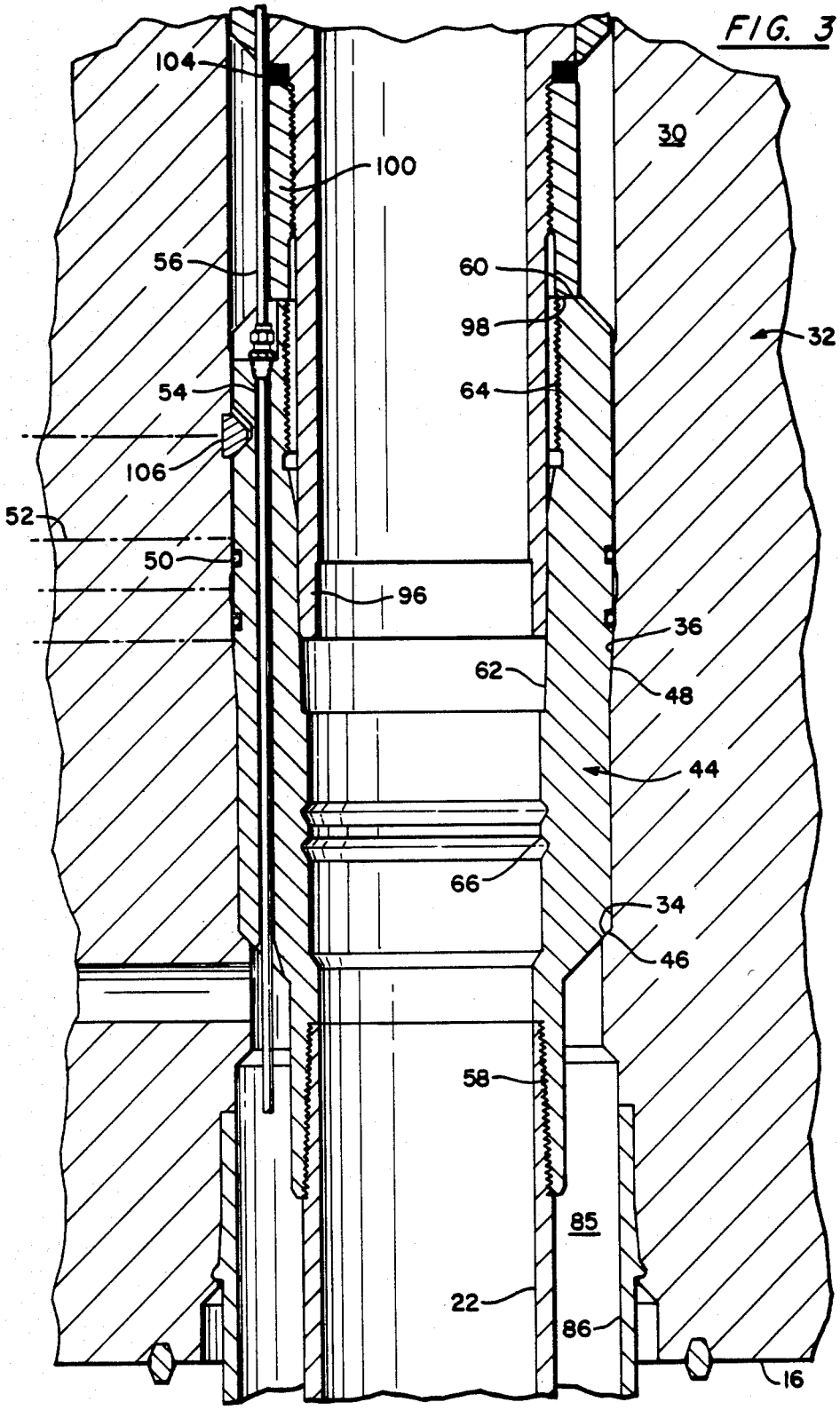
FIG. 3 is an enlarged view of the sealing and mating surfaces associated with the lower tubing hanger portion of the system shown in FIGS. 1 and 2.
Figure 4:
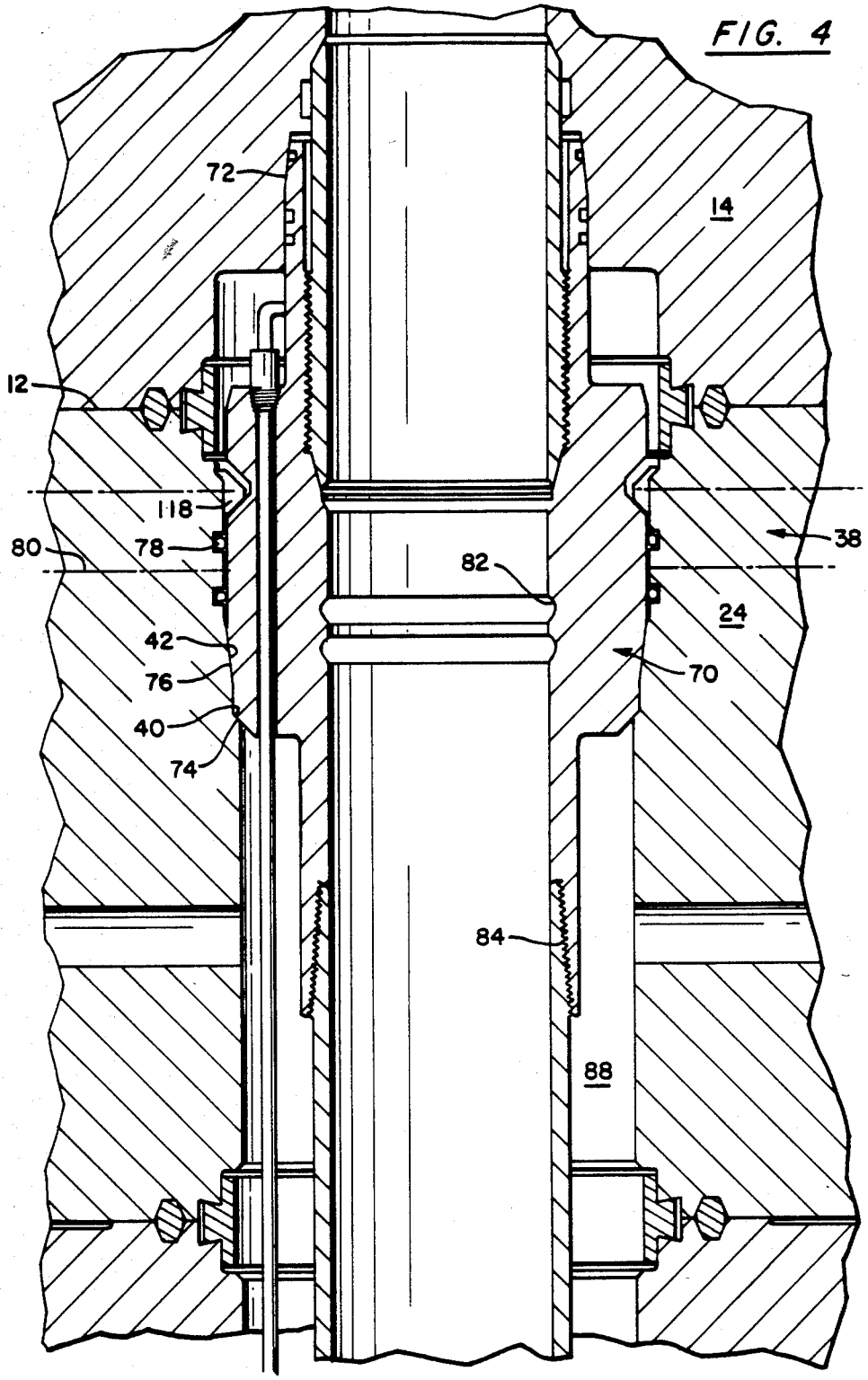
FIG. 4 is an enlarged view of the mating and sealing surfaces associated with the upper tubing hanger portion of the system shown in FIGS. 1 and 2.

FIG. 2 is a schematic sectioned view of the upper end of the production tubing string 22, and the structures associated with the tie back assembly 23 within the shear ram tubing head system stack 30 shown in FIG. 1. The overall arrangement of the structures associated with the tie back assembly 23 and their mounting within the stack 30, will be described with reference FIG. 2. FIGS. 3 and 4 show details of the tubing hangers and the sealing and load bearing surfaces, as well as conventional structures commonly employed for making hanger connections in oilfield equipment.

As shown in FIGS. 2, 3, and 4 the stack 30 includes a lower tubing hanger bowl 32 located in lower tubing head 28, in which are provided double tapered load carrying control shoulder 34 and a metal-to-metal seal surface 36. The upper tubing hanger bowl 38 is provided in upper tubing hanger head 24, and includes double tapered load carrying control shoulder 40 and metal-to-metal seal surface 42.

The lower tubing hanger 44 is sealingly supported by the lower tubing hanger bowl 32 by means of the double tapered, mating load transfer surface 46 and metal-to-metal sealing surface 48. This primary seal is of a conventional design, readily available from the Gray Tool Company as part of the CWCT line of well control equipment. As shown in FIG. 3, secondary annular elastomer seals 50 may be provided on the outer surface of the lower tubing hanger, as well as testing ports 52 as is well known in this art. Also, passages 54 are machined vertically through the hanger body 44 to accomodate control lines 56 that may optionally be provided for downhole equipment control, as is well known in the art. The lower internal portion of the tubing hanger 44 is threaded 58 to engage the upper end of the tubing 22, such that the entire weight of the tubing is supported by the lower tubing hanger 44 from the lower hanger bowl 32. The lower tubing hanger 44 also includes at its upper end a load bearing control shoulder 60, and on its interior surface between the control shoulder 60 and the lower threads 58, a tapered surface 62 against which a metal-to-metal seal will be effected as described below. As an aid to installation of the tie back assembly 23 the interior of the lower tubing hanger 44 is also provided with a tool running mount 64. Preferably, a tubing plug profile 66 is provided immediately above the threads 58. The running mount 64 and tubing plug profile 66 are conventional, and need not be further described.

The upper tubing hanger 70 includes a neck 72 for engaging the Xmas tree and load transfer surface 74 and metal sealing surface 76 for engaging the upper tubing hanger bowl 38. The upper tubing hanger interface with the bowl is similar to that of the lower tubing hanger 44, including the secondary annular seals 78 and test ports 80. The upper tubing hanger 70 also has a tubing plug profile 82 on its interior surface, and threads 84 at the lower interior and for engaging the tie back tubing nipple as described below. The upper profile 82 is large enough to pass the smaller diameter tubing plug associated with the lower hanger profile 66.

It may be appreciated that when the upper and lower tubing hangers 70,44 are secured in place, the casing annulus 85 between the tubing 22 and casing 86, is sealed off at 36. This seal, preferably metal-to-metal, holds against the full well bore pressure. The metal-to-metal seal associated with the upper tubing hanger 70 at seal surface 42, prevents upward leakage of fluid that may be present in the stack annulus 88.

The tie back sub assembly 90, shown fully in FIG. 2, provides a fluid flow path between the lower tubing hanger 44 and the upper tubing hanger 70, and more importantly, the tie back assembly may be severed by the shear ram while maintaining the integrity of the load bearing and sealing surfaces associated with the upper and lower tubing hangers. This is a challenging requirement in designs where it is desired that these sealing surfaces 36, 42, as well as the bore seal 96 to be discussed below, are metal-to-metal.

The tie back sub assembly includes a tie back spacer member 92 threaded to a tie back tubing nipple 94, the tubing nipple serving as the sacrificial member for severence by the ram 26 mounted on the shear ram tubing head system stack 30 (FIG. 1). The lower portion of the tie back spacer member 92 has an interior stab nipple extension 96 for engaging the inwardly tapered surface 62 on the lower tubing hanger. The stab nipple 96 maybe of the type known as metal-flex seals, which have been available as standard equipment from the Gray Tool Company. The outer lower portion of the spacer member 92 includes a load bearing control shoulder 98, preferably in the from of an adjustable locking ring 100. The control shoulder 98 abuts the load bearing control shoulder 60 at the upper end of the lower tubing hanger 44.

It should be appreciated that, in order to provide a reliable, effective metal-to-metal seal between the stab nipple 96 and the tapered internal sealing surface 62 of the lower tubing hanger 44, the distance from the spacer member control shoulder 98 to the upper tubing hanger control surface 74, must be exactly dimensioned. This is particularly difficult to achieve over a distance of nearly 15 feet, which is typically associated with the system shown in FIG. 1. Although the stab nipple 96 can effectively seal against the tapered internal surface 62 anywhere within $\pm\frac{1}{2}$ inch from the nominal landing target, the maintenance of an effective seal at the upper tubing hanger interface at 42, requires that the distance from the control surface 40 to the lower tubing hanger control shoulder 60, be matched within about 1/32 inch by the tie back assembly. The tie back assembly comprises the tie back subassembly 90 when fully connected to the upper tubing hanger 70. This distance cannot be accurately determined from as built drawings of the shear ram tubing head system 10, nor from measurements of the hangers and tie back members prior to installation, due to tolerance stack-up in the field.

A feature of the preferred embodiment of the present invention is the capability to accurately adjust the dimensions of the tie back assembly so that all the required seals and load bearing surfaces maintain their integrity both before and after severance of the tie back tubing nipple 94. The adjustments are achieved by providing shims 104 to interact with the load ring 100, and by mounting the tie back tubing nipple 94 to provide rough control of overall tie back assembly distance. This adjustment is made in the field at the time of installing the tie back assembly within the tubing head system 10, as will be described below. In effect, the adjustment optimizes the distance between the leading edge of the stab nipple 96, and the control shoulder 98.

The procedure for installing the system shown in FIGS. 1–4 will be described in the context of bringing a well into production immediately after successful drilling. With only minor variations evident to anyone familiar with oilfield equipment technology, the procedure can be readily adapted for retrofitting the inventive system tie back assembly on producing wells.

The description of the installation procedure will refer to FIGS. 1–5. After drilling operations are finished and all casing strings 86 have been run, the drilling BOPs are removed and the shear ram system 10 is installed on the wellhead 18. The system 10 may have an integral housing, or may be a composite of the upper tubing head 24, shear ram 26, and lower tubing head 28. The completion BOPs are then installed on top of the upper head 24. The production tubing 22 is run into the well, and before the last section of tubing is lowered through the stack 30, the components of the present invention are brought together to be made up as illustrated in FIGS. 2–4.

A lower tubing hanger 44 of the type illustrated in FIGS. 2 and 3, is attached to the upper end of the production tubing 22. In situations where control lines are required, these lines 56 are strung through the passages 54 in the lower tubing hanger 44. A landing sub (not shown) is connected to the running mount 64 in the lower tubing hanger, then the hanger and tubing is lowered through the stack 30 and landed in the lower tubing head bowl 32 while maintaining control and orientation of the control lines 56. In a conventional manner, the hold down set screws 106 are actuated and the metal-to-metal seal 36 verified through the test ports 52. The running tool is then disengaged and withdrawn from the stack 30.

Figure 5:
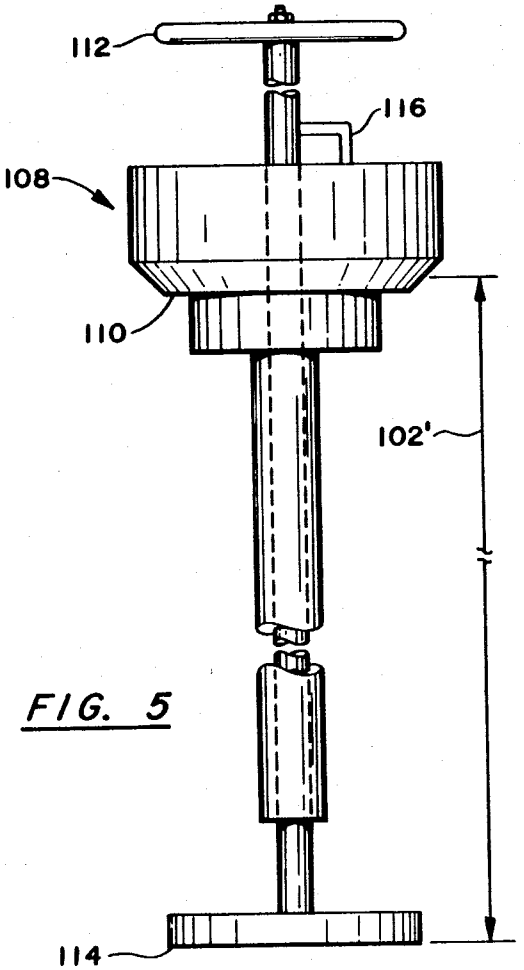
FIG. 5 is a schematic illustration of one space out measuring tool suitable for practicing the embodiment of the invention illustrated in FIGS. 1–4.

Although not preferred, the lower tubing hanger could be a non-stab type i.e., threaded or otherwise sealingly secured to the tubing head, so long as the control shoulder 60 and interior taper 62 are provided. Once the lower tubing hanger is in place, the space out between the control shoulder 60 and the control shoulder 40 on the upper tubing hanger bowl 38, must be accurately determined. A measuring tool 108 suitable for this purpose is schematically illustrated in FIG. 5. Based on nominal dimensions the approximate distance between these points, hereinafter referred to as the critical distance 102, is estimated. The measuring tool probe distance 102 is set at approximately one inch less than the estimated critical distance. The tool is lowered through the upper portion of the casing 30 until the base 110 thereof mates with the control shoulder 40 in the upper tubing head bowl 38. The extension wheel 112 on the tool is manually rotated from above the stack 30, thereby advancing the measuring probe 114 until the probe contacts the control shoulder 60. The measuring tool shaft is locked 116 and the tool 108 is then withdrawn from the stack 30. The exact critical distance 102 is measured on the retrieved tool.

The tie back assembly, consisting of the upper tubing hanger 70, spacer tubing nipple 94, and tie back spacer member 92, are assembled as a unit for insertion into the stack. The critical distance is established on the tie back assembly by adjusting the number of shims 104 trapped by the ring 100. Each shim is typically about 1/32 inch thick. The effective length of the tie back tubing nipple 94 when fully threaded and shouldered at both ends, is also available as a rough adjustment, by trimming to within about $\frac{1}{2}$ inch.

The tie back assembly is then oriented over the control lines 56 and passed downwardly thereover through the passages 54 in the upper tubing hanger 70, until the stab nipple 96 contacts the lower hanger interior surface 62 and upper hanger lands in its respective bowl 38. Seating of the upper hanger effects metal-to-metal seals at surface 42, thereby sealing off the stack annulus 88, and forming a metal-to-metal seal at the interference engagement of the stab nipple 96 with the tapered internal surface 62 on the lower tubing hanger 44. These seals are accomplished with a simple axial stab. The upper tubing hanger is then locked down by actuation of the hold down set screws 118 or in any other conventional manner.

It should be noted that when reference is made to the tapered interior 62 of the lower tubing hanger, any taper angle ranging from 0° to about 45° is intended, so long as the interior surface 62 and the stab nipple 96 interact to form a seal energized by an interference fit resulting from relative axial movement.

In the preferred embodiment, conventional tubing plugs (not shown) are installed in the profile 66, 82 provided in the lower tubing hanger 44 and the upper tubing hanger 70, respectively. The profile at the upper hanger may be of a slightly larger diameter to permit passage of the lower tube plug therethrough.

Additional steps are conventional and include connecting the Xmas tree 14, making up control line fittings, cutting off excess control lines, and retrieving the tubing plugs.

Upon completion of the installation, the wellhead has primary metal-to-metal seals at the lower tubing hanger, against fluid pressure in the casing annulus 85. Bore hole integrity is maintained by the metal-to-metal seal between the stab nipple 96 and the lower tubing hanger 44. The stack annulus 88 is isolated by the metal-to-metal seal of the upper tubing hanger. Thus, the tie back assembly establishes both pressure and mechanical continuity between the upper and lower tubing hangers. Columnar loads on the stab nipple seal 96 are limited by the abutment of the load ring 100 against the control shoulder 60 on the lower tubing hanger 44. This prevents plastic deformation of the seal surfaces.

Figure 6:
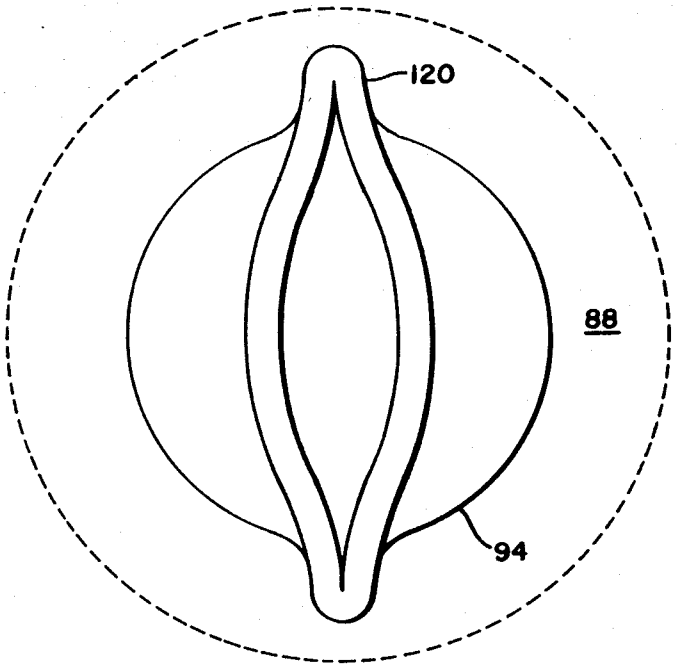
FIG. 6 is a section view taken along lines 6—6 of FIG. 2, showing a typical tubing section stub resulting from a horizontal, planar shear ram severance of the tubing.

In the preferred embodiment, the stack 30 carries shear rams that sever the neck of the tubing nipple 94 in the event of a loss of control of the wellhead. FIG. 6 is a view taken along line 6—6 of FIG. 2, showing a typical tubing section stub 120 resulting from a horizontal, planar shear ram action. After control of the well is reestablished, the stub 120 can be retreived as follows. A tubing plug is installed in the upper tubing hanger and the BOP stack is connected. The tubing plug is then retreived. A conventional landing tool is connected to the upper hanger and the hanger hold down screws retracted, so that the upper tubing hanger and upper tubing stub may be retreived. The tubing shear rams are then opened, and a fishing tool is lowered onto the lower tubing stub. The stub is grabbed and lifted, thereby raising the tie back sub assembly consisting of the tie back spacer member 92, shims 104 and load ring 100, and the stub portion of the tubing nipple 94.

Shear rams which provide a stub configuration similar to that illustrated in FIG. 6 are preferred, because a small, generally oblong opening is available for inserting a retreiving tool which can be expanded below the opening and then lifted to remove the tie back sub assembly.

Although the preferred embodiment of the present invention has been described in conjunction with a shear ram safety system, it should be appreciated that the tie back assembly itself can be advantageously used in other embodiments, and the claimed invention is intended to cover such other embodiments. For example, a well operator may desire the added safety margin associated with two, independently mounted tubing plugs that may optionally be carried in the upper and lower tubing hangers, in accordance with the invention. In more general terms, the invention could be advantageously used wherever it is desired to extend the length of the tubing string in the wellhead, while maintaining sealing and structural integrity effected by stab type, metal-to-metal makeup.

We claim:

1. A multiple tubing hanger tie back assembly comprising:

a lower tubing hanger (44) sealingly secured within a lower tubing head (28) for supporting a tubing string (22), said lower hanger including a control shoulder (60) at its upper end and a tapered interior surface (62);

an upper tubing hanger (70) spaced above said lower hanger (44) and sealingly secured within an upper tubing head (24);

a tie back subassembly (90) connecting said upper and lower tubing hangers, including an upper neck section (94) secured to the lower end of the upper tubing hanger (70), and a lower spacer section (92) including a downwardly projecting inner stab nipple (96) in interference fit engagement with said tapered interior surface (62) and a downwardly facing, outer load transfer surface (98) abutting said control shoulder (60).

2. The assembly of claim 1 wherein said upper neck section (94) is a tubing nipple connected at its lower end to said spacer section (92).

3. The assembly of claim 1 wherein said outer load transfer surface includes means (104) for adjusting the vertical distance between the load transfer surface (98) and the lower end of the stab nipple (96).

4. The assembly of claim 2 wherein said outer load transfer surface includes means (104) for adjusting the vertical distance between the load transfer surface (98) and the lower end of the stab nipple (96).

5. The assembly of claim 3 wherein said adjusting means includes a plurality of stacked shims (104) and a locking ring (100).

6. The assembly of claim 4 wherein said adjusting means includes a plurality of stacked shims (104) and a locking ring (100).

7. The assembly of claim 1 wherein said upper tubing hanger (70) includes an interior profile (82) adapted to receive a tubing plug, and said lower tubing hanger (44) includes an interior portion below said tapered surface having a profile (66) adapted to receive a second tubing plug, the profile on the upper hanger sized to allow passage of the second tubing plug.

8. An oil well tubing head system for installation between a rigidly supported wellhead (18) and a Xmas tree (14), comprising:

a system housing (10) including an upper tubing head (24) connected to the Xmas tree (14), a lower tubing head (28) connected to the wellhead (18) and a tubing shear ram (26) connected between the upper and lower tubing heads, the interior of said housing including a stack (30) containing a generally cylindrical vertical passageway (25) therethrough;

a lower tubing hanger (44) supported within the lower tubing head (28) for carrying a tubing string (22), said lower hanger including a control shoulder (60) at its upper end and a tapered interior surface (62);

an upper tubing hanger (70) supported within the upper tubing head (24);

a tie back subassembly (90) connecting said upper and lower tubing hangers, including a tubing section (94) passing through the bore of the shear ram (26), and being secured to the lower end of the upper tubing hanger, and further including a spacer member (92) secured to the lower end of the tubing section, said spacer member including a downwardly projecting inner stab nipple (96) in interference engagement with said tapered inner surface (62) and a downwardly facing, outer load transfer surface (98) abutting said control shoulder (60);

whereby upon actuation of the shear ram (26), the tubing section (94) is severed without downward movement of the tubing string (22).

9. A method for installing a tie back subassembly to make up a multiple tubing hanger assembly, wherein the tie back assembly includes a lower tubing hanger (44) having a control shoulder (60) at its upper end and a tapered interior surface (62), a lower tubing head (28), an upper tubing hanger (70), an upper tubing head (24), and a tie back subassembly (90) including an upper neck section (94) secured to the lower end of the upper tubing hanger (70) and a lower spacer section (92) having a downwardly projecting inner stab nipple (96) and an outer load transfer surface (98), comprising the steps of:

landing the lower tubing hanger (44) onto a mating surface (34) of the lower tubing head (28);

measuring the critical distance (102) between the lower tubing hanger control shoulder (60) and a control shoulder (40) in the upper tubing head (24) where the upper tubing hanger (70) will be landed;

making up a tie back assembly by connecting the upper tubing hanger (70) to the upper neck portion (94) of said subassembly (90) such that the critical length between a load transfer surface (74) on the upper tubing hanger (70) and the control shoulder load transfer surface (98) on the spacer section (92) is equal to the measured critical distance;

inserting the tieback assembly downwardly toward the lower tubing hanger until the stab nipple (96) contacts the tapered interior surface (62) of the lower tubing hanger (44); and continuing to lower the assembly until the upper tubing hanger (70) and the load transfer control shoulder (98) of the spacer section (92) simultaneously abut their respective mating surfaces (40, 60).

10. The method of claim 9 wherein the step of making up a tie back assembly includes connecting a tubing nipple (94) to the lower end of the upper tubing hanger (70) and connecting a spacer member (92) to the lower end of the tubing nipple (94).

11. The method of claim 10 further including the steps of trimming the tubing nipple (94) such that when the nipple is fully shouldered against the upper tubing hanger and the spacer member, the critical length on the tie back assembly is approximately equal to said critical distance (102).

12. The method of claim 9 wherein the step of making up a tie back assembly includes the step of adjusting the distance between the load transfer surface (98) and the lower end of the stab nipple (96).

13. The method of claim 12 wherein the adjusting step includes operatively associating a sufficient number of shims with the downwardly facing, outer load transfer surface (98) of the spacer section (92), to match the critical length to said critical distance (102), within less than about ½ inch.

* * * * *